F6966 XR 4,257,906

United States Patent [19]

Crutchfield

[11] 4,257,906

[45] Mar. 24, 1981

[54] METHOD OF PROTECTING NITRILOTRIACETATE SALTS

[75] Inventor: Marvin M. Crutchfield, Creve Coeur, Mo.

[73] Assignee: Monsanto Company, St. Louis, Mo.

[21] Appl. No.: 112,005

[22] Filed: Jan. 14, 1980

[51] Int. Cl.[3] ..... C11D 7/60

[52] U.S. Cl. ..... 252/99; 252/102; 252/187 H; 252/89.1; 8/108 R; 8/109; 423/385; 423/388

[58] Field of Search ..... 252/102, 99, 187 H, 252/89.1; 8/108 R, 109; 423/385, 388

[56] References Cited

U.S. PATENT DOCUMENTS

| | | | |
|---|---|---|---|
| 4,088,611 | 5/1978 | Suzaki et al. | 252/541 |
| 4,148,742 | 4/1979 | Crutchfield | 252/102 |

FOREIGN PATENT DOCUMENTS 2658181 7/1977 Fed. Rep. of Germany .

*Primary Examiner*—Mayer Weinblatt

*Attorney, Agent, or Firm*—S. M. Tarter; W. H. Duffey; R. C. Griesbauer

[57] ABSTRACT

The trialkali metal salts of nitrilotriacetate are well known detergent builders. However, when hypochlorite bleach is added to the wash water it can oxidize the soluble uncomplexed nitrilotriacetate with the resultant loss of the beneficial effects of the use of such salts as a builder. Now, a method has been developed of protecting the desirable builder properties of the trialkali metal nitrilotriacetate in an aqueous solution containing active chlorine which comprises adding to the nitrilotriacetate a sufficient amount of trialkali metal imidodisulfate to protect at least some of the nitrilotriacetate from damage by the chlorine.

12 Claims, No Drawings

METHOD OF PROTECTING NITRILOTRIACETATE SALTS

BACKGROUND OF THE INVENTION

This invention relates to the protection of trialkali metal nitrilotriacetate in an aqueous solution containing active chlorine.

The property possessed by some materials of improving the detergency levels of soaps and synthetic detergents and the use of such materials in detergent compositions is known. Such cleaning boosters are called "builders" and such builders permit the attainment of better cleaning performance than is possible when so-called unbuilt compositions are used. The behavior and mechanisms by which builders perform their function are not completely understood. It is known that good builders must be able to sequester most of the free calcium and/or magnesium ions in the wash water since these ions are detrimental to the detergency process. However, it is difficult to predict which class of compounds possess useful combinations of builder properties and which compounds do not because of the complex nature of detergency and the countless factors which contribute to overall performance.

The alkali metal salts of nitrilotriacetate have been found to be highly efficient cleaning and detergency builders and these compounds, particularly trisodium nitrilotriacetate, have been employed with good results in cleaning and detergent formulations. Indeed, millions of pounds of trisodium nitrilotriacetate are used each year in cleaning formulations because of its superior builder qualities. However, when a chlorine-containing bleach, such as sodium hypochlorite, is added to the aqueous solution containing a detergent formulation using a trialkali metal nitrilotriacetate as a builder, the chlorine can react rapidly with free nitrilotriacetate anion that has not already complexed calcium and/or magnesium ions, resulting in a loss not only of the beneficial effects of the excess quantity of nitrilotriacetate as a detergency booster, but also with the concurrent loss of active chlorine for use as a bleach.

U.S. Pat. No. 4,148,742 issued Apr. 10, 1979 discloses that the alkali metal salts of imidobisulfuric acid, particularly the trisodium salt, are effective in heavy duty laundry detergent compositions by reducing the damaging effects of chlorine-containing bleaches on the fabric while minimizing the loss in effectiveness of the bleach to remove stains from soiled fabrics. Further, Japanese Pat. publication No. 153,537 dated Dec. 23, 1975 discloses detergent compositions containing an anionic surfactant, a trialkali metal imidodisulfate, and trisodium nitrilotriacetate or sodium citrate to improve the builder action of the imidodisulfate, allowing lower concentrations of the latter to be used. However, it has been found that in hard water containing 150 ppm calcium hardness or greater, the trialkali metal imidodisulfates are only about 20 percent as effective as trisodium nitrilotriacetate as a builder.

Despite the advantages taught in these and other references in the prior art, it has now been surprisingly found that the trialkali metal nitrilotriacetates, when in aqueous solution also containing active chlorine, can be protected from damage by the chlorine by the process of the present invention. Thus, the builder properties of the non-effective trialkali metal nitrilotriacetate are maintained at a high level. Even though trialkali metal imidodisulfates have been disclosed as useful to reduce the damaging effects of chlorine-containing bleaches on the fabric while minimizing the loss in effectiveness of the bleach in removing stains from the soiled fabric, it was surprisingly found that the alkali metal salts of imidobisulfates would also protect the nitrogen-containing nitrilotriacetate from damage by the active chlorine. According to the method of the present invention, it has now been found that the builder properties of the trialkali metal nitrilotriacetates can be protected in an aqueous solution containing active chlorine.

SUMMARY OF THE INVENTION

These and other advantages are achieved by a method of protecting trialkali metal nitrilotriacetate from active chlorine in aqueous solution which comprises adding to the nitrilotriacetate before contact with active chlorine in solution, a sufficient amount of trialkali metal imidodisulfate to protect at least some of the nitrilotriacetate from active chlorine damage.

For the purposes of this invention, the term "NTA" shall mean the trialkali metal salts of nitrilotriacetate, such as trisodium nitrilotriacetate, tripotassium nitrilotriacetate, mixed salts of sodium and potassium nitrilotriacetate, and mixtures thereof. The term "TSIS" shall mean the trialkali metal salts of imidodisulfate, such as trisodium imidodisulfate, tripotassium imidodisulfate, mixed salts of sodium and potassium imidodisulfate, and mixtures thereof. The imidodisulfates are sometimes referred to as imidodisulfonates or as imidobisulfates and have the following formula:

$$MN(SO_3M)_2$$

where M is an alkali metal, preferably sodium.

As is known to those skilled in the art, the NTA can be added along with the surfactant in a detergent composition or the surfactant, the NTA builder and the other detergent ingredients can be added separately to a wash solution. Whether or not the ingredients are in a detergent formulation or added separately to the wash water, the total amount of detergent ingredients that are added to the wash water in North America usually amounts to about 1,200 to about 1,500 ppm by weight in the water. NTA detergent compositions generally comprise at least 5 percent by weight of a surfactant selected from the group consisting of anionic, nonionic, zwitterionic, ampholytic or amphoteric surfactants and at least 5 weight percent of NTA.

In many home washing processes, a sufficient amount of a halogen-containing bleach, for example sodium hypochlorite, is also added to the wash water to bring the concentration of the active chlorine up to between about 20 and about 200 ppm. Thus, a detergent formulation may optionally contain solid halogen-containing bleaches if the detergent composition is dry or liquid bleaches such as a 5 percent solution of sodium hypochlorite may be added during the wash. Halogen-containing bleaches include sodium hypochlorite, calcium hypochlorite, and the sodium and potassium salts of dichloroisocyanurate, trichloroisocyanuric acid and (monotrichloro)tetra(monopotassiumdichloro)pentaisocyanurate and the like. Although other halogen-containing bleaches may be used, chlorine-containing bleaches are preferred for detergent applications due to their lower cost.

According to the process of the present invention, there is added to the wash water prior to or at least during chlorine bleach addition, either as part of a prepared detergent formulation or separately, a sufficient amount of TSIS to protect at least some of the NTA from damage by the active chlorine. Although Applicant does not wish to be bound by any particular theory, it is believed that the active chlorine from the bleach reacts with and destroys uncomplexed NTA by oxidation, reducing its effectiveness as a builder. Further, such reaction decreases the amount of available active chlorine to act as a bleach.

According to the process of the present invention, it is preferred to use at least 5 percent by weight of a builder based on the weight of the detergent formulation added to the wash water and even more preferred that the detergent composition contain from about 5 percent to about 25 percent or higher, for example up to about 60 percent by weight, NTA. NTA can be the sole detergency builder or it can be used in combination with other detergency builders. By way of example, builders which can be employed with the NTA for use in the process of the present invention include either water insoluble materials such as sodium alumino silicates, commonly known as zeolites, or water soluble inorganic builder salts such as alkali metal polyphosphates, alkali metal carbonates, borates, bicarbonates and silicates and water soluble organic builders including polycarboxylic acids and salts, ether polycarboxylates, oxidized starches, amino(trimethylene phosphonic acid) salts, polymeric polycarboxylates such as polymeric acetal carboxylate salts, and the like.

The total amount of builder employed will be dependent upon the intended use of the detergent composition, other ingredients of the composition, pH conditions, water hardness values, and the like. For example, general laundry powder formulations usually contain from about 20 percent to about 60 percent builder. Optimum levels of builder content as well as optimum mixtures of builders with other builders for various uses can be determined by routine tests in accordance with conventional detergent formulation practice.

The quantity of surfactant employed in the detergent composition will depend on the surfactant chosen and the intended end use. Any water soluble anionic, nonionic, zwitterionic or amphoteric surfactant can be employed. In general, the compositions will contain from 5 percent to 50 percent surfactant by weight, although as much as 95 percent surfactant may be employed. For example, general laundry powder formulations normally contain 5 percent to 50 percent, preferably 10 percent to 25 percent surfactant by weight. The weight ratio of surfactant to builder, e.g., NTA, will generally be in the range of from 1:12 to 2:1.

Examples of suitable anionic surfactants include soaps such as the salts of fatty acids containing about 9 to 20 carbon atoms, e.g., salts of fatty acids derived from coconut oil and tallow; alkylbenzene sulfonates—particularly linear alkylbenzene sulfonates in which the alkyl group contains from 10 to 16 carbon atoms; alcohol sulfates; ethoxylated alcohol sulfates, hydroxy alkyl sulfonates, alkyl sulfates and sulfonates; monoglyceride sulfates; acid condensates of fatty acid chlorides with hydroxy alkyl sulfonates; and the like.

Examples of suitable nonionic surfactants include alkylene oxide (e.g., ethylene oxide) condensates of mono- and polyhydroxy alcohols, alkyl phenols, fatty acid amides, and fatty amines; amine oxides; sugar derivatives such as sucrose monopalmitate; long chain tertiary phosphine oxides, dialkyl sulfoxides; fatty acid amides (e.g., mono- or diethanol amides of fatty acids containing 10 to 18 carbon atoms); and the like.

Examples of suitable zwitterionic surfactants include derivatives of aliphatic quaternary ammonium compounds such as 3-(N,N-dimethyl-N-hexadecyl-ammonio)-2-hydroxy propane-1-sulfonate.

Examples of suitable amphoteric surfactants include betains, sulfobetains and fatty acid imidazole carboxylates and sulfonates.

It will be understood that the above examples of surfactants are by no means comprehensive and that numerous other surfactants are known to those skilled in the art. It will be further understood that the choice and use of surfactants will be in accordance with well understood practices of detergent formulation. For example, anionic surfactants, particularly linear alkylbenzene sulfonate, are preferred for use in general laundry formulations.

In light of the present disclosure it can be seen that NTA can now be used in machine dishwashing formulations, which normally contain active chlorine, as a partial or complete replacement for the phosphates in such formulations. To be suitable for use in machine dishwashing, a formulation must effectively clean the articles being washed and allow them to complete the drying cycle without excessive filming or spotting, which is largely attributed to the presence of alkali metal tripolyphosphates in presently used machine dishwashing formulations. With the emphasis on removing phosphates from cleaning formulations, coupled with the continuing objective of the detergent industry to develop formulations of improved performance, it can be seen that there is a need for a new machine dishwashing formulation with characteristics equivalent to those containing alkali metal tripolyphosphates containing a reduced amount of phosphorus.

Now, according to one embodiment of the present invention, there is provided a new machine dishwashing formulation which is equal to, if not superior to, machine dishwashing formulations containing alkali metal tripolyphosphates, which is achieved by a machine dishwashing formulation comprising (A) from 0.5 to 5 percent by weight of a surfactant selected from the group consisting of low-foaming anionic and nonionic surfactants and mixtures thereof, (B) an active chlorine-providing material selected from the group consisting of potassium dichlorocyanurate, sodium dichlorocyanurate, [(monotrichloro)tetra-(monopotassium dichloro)]-pentaisocyanurate, (mono-trichloro)(mono-potassium dichloro)di-isocyanurate and chlorinated trisodium phosphate, said active chlorine-providing material constituting from about 10 to about 30 percent by weight of the formulation when said material is a chlorinated trisodium phosphate and from 0.5 to 5 percent by weight of the formulation when said material is a chlorocyanurate, and (C) from 20 to 90 percent of a mixture of trialkali metal nitrilotriacetate and trialkali metal imidodisulfate in a weight ratio between about 2:1 and about 1:2.

The surfactants for use in the formulation of the present invention are those that are known to those skilled in the art. It is only necessary that the surfactant is a low-foaming surfactant and, of course, does not react with chlorine or the active chlorine-providing material. Nonionic and anionic surfactants conventionally employed in machine dishwashing formulations are preferred. Examples of suitable nonionic surfactants include ethoxylated alkyl phenols, ethoxylated alcohols, both mono- and dihydroxy alcohols, polyoxyalkylene glycols, aliphatic polyethers and the like. The widely commercially utilized condensates of polyoxypropylene glycols having molecular weights of from about 1,400 to 2,200 with ethylene oxide (the ethylene oxide constituting 5 to about 35 percent of the condensate) are advantageously used in formulations of the present invention. Suitable low-foaming anionic surfactants include alkyl diphenyl ether sulfonates such as sodium dodecyl diphenyl ether disulfonates, and alkyl naphthalene sulfonates. Mixtures of such surfactants can be utilized if desired.

As will occur to those skilled in the art in view of the present invention, the formulation may also contain an anti-foaming agent which will permit the use of other surfactants and the use of such anti-foaming agents permit the selection of a wider group of surfactants for use in the formulation of the present invention.

The surfactant component will constitute from about 0.5 to about 5 percent, preferably from about 1 to about 4 percent by weight of the formulation of this invention.

To aid in the cleaning action, the rinsing characteristics and to provide desirable germicide and sanitizer action, the formulation of the present invention will also contain from about 0.5 percent to about 5 percent, preferably about 1 percent to about 3 percent by weight, of a chlorocyanurate or from about 10 percent to about 30 percent by weight of a chlorinated trisodium phosphate. The chlorocyanurate can be sodium or potassium dichlorocyanurate, [(mono-trichloro)tetra-(monopotassium dichloro)]pentaisocyanurate, (mono-trichloro)(monopotassium dichloro)diisocyanurate or mixtures thereof. The use of the dichlorocyanurates or the [(mono-trichloro)tetra-(monopotassium dichloro)]penta-isocyanurate is particularly preferred.

The remaining essential ingredient of the formulation of the present invention is the mixture of alkali metal salts of nitrilotriacetate and imidodisulfate, preferably the sodium salts, which will constitute from about 20 to about 90 percent, preferably from about 35 to about 50 percent by weight of the formulation. The mixture can be prepared by any number of methods known to those skilled in the art, such as by blending or mixing the powders or granules of the nitrilotriacetate salt and the imidodisulfate salt, forming an aqueous solution of the salts and thereafter removing the water, and the like. On the other hand, nitrilotriacetonitrile can be hydrolyzed with an alkali metal hydroxide in the presence of diammonium imidodisulfate to simultaneously form the corresponding alkali metal salts. Other methods of preparing the mixture will occur to those skilled in the art.

Desirably, the formulation of the present invention will additionally contain from about 5 percent to about 30 percent by weight soluble sodium silicate having an $SiO_2$ to $Na_2O$ mole ratio of from about 1:1 to about 3.2:1, preferably about 2.4:1, to inhibit corrosion of metal parts of dishwashing machines and provide overglaze protection to fine china. The balance, if any, of the machine dishwashing formulation of the present invention will be essentially conventional filler components such as soda ash, sodium chloride, sodium sulfate, water or mixtures thereof. If desired, the formulation may also contain minor amounts of conventional additives such as antitarnish agents.

The amount of TSIS for use in the process and in the machine dishwashing formulation of the present invention can vary within wide limits. It has been found that some beneficial effect is achieved when as little as 1 part by weight of TSIS is used for each 20 parts by weight of NTA. However, it is preferred to use a weight ratio of TSIS to NTA of from about 1:2 to 2:1 in the wash solution. Higher ratios of TSIS to NTA can be used, but there is not a proportional increase in the protection afforded to the NTA from the increased levels of TSIS. Satisfactory results are obtained when the weight ratio of TSIS to NTA is at least about 1:1.

DESCRIPTION OF THE PREFERRED EMBODIMENTS

This invention is illustrated by but not limited to the following Examples wherein all percentages are by weight unless otherwise noted and the NTA is trisodium nitrilotriacetate monohydrate and the TSIS is trisodium imidodisulfate, either anhydrous or in one of its hydrated forms, with the weight compared on an anhydrous basis.

EXAMPLE I

Trisodium imidobisulfate is prepared by the method described by P. Baumgarten, BER, 6913, 2,929–2,937 (1936). To 57 grams (0.5 mole) ammonium sulfamate in a 400 milliliter beaker was added 48.5 grams (0.5 mole) sulfamic acid. The solids in the beaker are heated on a hot plate. At about 120° C., a stirrable melt is obtained and at about 150° C., the melt begins to solidify. The beaker is removed from the hot plate and when the solid is cool, it is broken apart and dissolved in 128 grams of 50 percent sodium hydroxide to which water is added to bring the total volume to 450 milliliters. The solution is heated to expel ammonia, cooled to room temperature and filtered. The solution is chilled to 5° C., and a seed crystal is added, whereupon a precipitate instantly forms. The precipitate is recovered by filtration and dried in vacuo at room temperature. Analysis shows that 82.6 grams of $NaN(So_3Na)_2.H_2O$ is obtained.

EXAMPLE II

The TSIS from Example I was used in a series of experiments to compare the amount of active chlorine with NTA in the presence and absence of TSIS. To perform the experiments, deionized water at 120° F. (about 60° C.) containing 210 ppm sodium hypochlorite and 600 ppm NTA (typical use concentration) with and without TSIS from Example I was tested for active chlorine after 15 minutes and 30 minutes by adding an excess of potassium iodide, acidifying to pH 3 using acetic acid, and titrating to a light straw color using 0.1 N sodium thiosulfate. Then, a starch indicator was added, and the sample titrated to a loss of color. The percent active chlorine remaining in solution as determined by the iodide titration is shown below:

| TSIS Concentration | % Active Chlorine Remaining As A Function Of Time | | |
|---|---|---|---|
| (ppm) | 0 Min. | 15 Min. | 30 Min. |
| None | 100 | 80 | 62 |
| 600 | 100 | 97 | 80 |
| 800 | 100 | — | 89 |
| 1200 | 100 | — | 92 |

Thus it can be seen that the presence of TSIS prevents much of the loss of active chlorine over a 30-minute period.

EXAMPLE III

The TSIS from Example I is used in a series of experiments to compare the amount of NTA that is available in the presence of active chlorine as a function of time, with and without the presence of TSIS. To perform the experiments, deionized water containing 200 ppm sodium hydrochlorite, 600 ppm sodium carbonate as a pH buffer, and 600 ppm NTA, heated to 60° C. with and without TSIS from Example I, is sampled after 15 minutes and 30 minutes, and the amount of NTA remaining is determined by titration with standardized calcium chloride solution. The results are shown below as a percentage of the original NTA present.

| TSIS Concentration (ppm) | % NTA Remaining As A Function of Time | | |
|---|---|---|---|
| | 0 Min. | 15 Min. | 30 Min. |
| None | 100 | 76 | 66 |
| 600 | 100 | 94 | 90 |
| 800 | 100 | 94 | 94 |
| 1200 | 100 | 95 | 92 |

A machine dishwashing formulation is prepared consisting of 25 percent TSIS, 25 percent NTA, 35 percent of a 47 percent by weight aqueous solution of sodium silicate having an $SiO_2$ to $Na_2O$ mole ratio of 2.4:1; 3 percent Pluronic L62 (trademark of BASF-Wyandotte Corporation of Detroit, Mich., a nonionic surfactant of an ethylene oxide condensate of a polyoxypropylene glycol), 1.2 percent potassium dichlorocyanurate and 10.8 percent sodium sulfate. The formulation is used to wash soiled dishes and glassware in conventional automatic home dishwashing machine. Excellent cleaning is obtained and in particular the glassware is found substantially free from filming and spotting.

EXAMPLE V

A machine dishwashing formulation identical to that of Example IV is prepared except that Triton CF 10 (trademark of Rohm and Haas Company of Philadelphia, Pennsylvania, an alkylaryl polyether surfactant) is substituted for the Pluronic L62 and tested as in Example IV. Comparable results are obtained.

EXAMPLE VI

A formulation is prepared identical to that of Example IV with the exception that a condensate of n-decanol with 2 to 3 molecular proportions of ethylene oxide is substituted for Pluronic L62 and tested as in Example IV. Effective cleaning action is obtained.

EXAMPLE VII

The dishwashing test of Example IV is repeated with an otherwise identical formulation containing sodium dicyldiphenyl ether disulfonate as the surfactant. Comparable results are obtained.

Although the invention has been described in terms of specified embodiments which are set forth in considerable detail, it should be understood that this is by way of illustration only and that the invention is not necessarily limited thereto since alternative embodiments and operating techniques will become apparent to those skilled in the art in view of the disclosure. As an example, the TSIS used in the present process and in the present machine dishwashing formulation also acts as a buffer for the NTA to optimize performance of the NTA. In addition, the TSIS also protects other ingredients in formulations for cleaning fabrics and articles, such as optical brighteners, perfumes and some surfactants, from the deleterious effects of active chlorine. Accordingly, modifications are contemplated which can be made without departing from the spirit of the described invention.

What is claimed is:

1. A method of protecting trialkali metal nitrilotriacetate from active chlorine in aqueous solution which comprises adding to the nitrilotriacetate, before contact with active chlorine in solution, a sufficient amount of trialkali metal imidodisulfate to protect at least some of the nitrilotriacetate from active chlorine damage.

2. A method of claim 1 wherein the amount of trialkali metal imidodisulfate is at least 1 part by weight for each 20 parts by weight trialkali metal nitrilotriacetate.

3. A method of claim 1 wherein the weight ratio of trialkali metal imidodisulfate to trialkali metal nitrilotriacetate is from about 1:2 to about 2:1.

4. A method of claim 1 wherein the weight ratio of trialkali metal imidodisulfate to trialkali metal nitrilotriacetate is at least 1:1.

5. A method of claim 3 and 4 wherein the alkali metal is sodium.

6. A machine dishwashing formulation comprising:

(A) from about 0.5 to less than about 5 percent by weight of a surfactant selected from the group consisting of low-foaming anionic and nonionic surfactants and mixtures thereof;

(B) an active chlorine-providing material selected from the group consisting of potassium dichlorocyanurate, sodium dichlorocyanurate, [(mono-trichloro)tetra(monopotassium dichloro)]-pentaissocyanurate, (mono-trichloro)(mono-potassium dichloro)diisocyanurate and chlorinated trisodium phosphate, said active chlorine-providing material constituting from about 10 to about 30 percent by weight of the formulation when said material is chlorinated trisodium phosphate and from about 0.5 to about 5 percent by weight of the formulation when said material is a chlorocyanurate; and (C) from about 20 percent to about 90 percent of a mixture of trialkali metal nitrilotriacetate and trialkali metal imidodisulfate in a weight ratio between about 2:1 and 1:2.

7. The formulation of claim 6 wherein the mixture constitutes from about 35 percent to about 50 percent by weight of the formulation.

8. The formulation of claim 6 wherein the alkali metal is sodium.

9. The formulation of claim 7 wherein the surfactant is a nonionic surfactant.

10. The formulation of claim 7 wherein the active chlorine-providing material is potassium dichlorocyanurate.

11. The formulation of claim 7 wherein the surfactant is the condensate of polyoxypropylene glycol having a molecular weight of 1,400 to 2,200 with ethylene oxide, said ethylene oxide constituting 5 to about 35 percent by weight of the condensate.

12. The formulation of claim 7 wherein the formulation additionally contains about 5 percent to about 30 percent by weight soluble sodium silicate having an $SiO_2$ to $Na_2O$ mole ratio of from about 1:1 to about 3.2:1.

* * * * *